United States Patent [19]

Geier et al.

[11] Patent Number: 4,610,839

[45] Date of Patent: Sep. 9, 1986

[54] STORAGE CONTAINER AND CARRYING PEG FOR RADIOACTIVE MATERIAL

[75] Inventors: Rolf Geier, Bruchkobel; Berthold Racky, Nidderau, both of Fed. Rep. of Germany

[73] Assignee: Nukem GmbH, Hanau, Fed. Rep. of Germany

[21] Appl. No.: 565,003

[22] Filed: Dec. 23, 1983

[30] Foreign Application Priority Data

Dec. 24, 1982 [DE] Fed. Rep. of Germany ..... 82363595[U]

[51] Int. Cl.[4] ..... G21C 19/00

[52] U.S. Cl. ..... 376/272; 376/313; 252/633; 250/506.1; 220/303

[58] Field of Search ..... 376/272, 313; 252/633; 250/506.1, 507.1; 220/205, 303

[56] References Cited

U.S. PATENT DOCUMENTS

| | | | |
|---|---|---|---|
| 1,616,050 | 2/1927 | Kania | 220/205 X |
| 3,749,917 | 7/1973 | Kucherer | 250/506.1 X |
| 3,789,871 | 2/1974 | Tupper | 220/205 X |
| 4,016,749 | 4/1977 | Wachter | 376/272 X |
| 4,197,467 | 4/1980 | Williams | 250/507.1 X |
| 4,302,680 | 11/1981 | Ahner et al. | 250/506.1 |
| 4,377,509 | 3/1983 | Haynes et al. | 252/633 |
| 4,445,042 | 4/1984 | Baatz et al. | 376/272 X |
| 4,488,048 | 12/1984 | Bienek et al. | 376/272 X |
| 4,491,540 | 1/1985 | Larker et al. | 252/633 X |

*Primary Examiner*—Peter A. Nelson

*Attorney, Agent, or Firm*—Cushman, Darby & Cushman

[57] ABSTRACT

A storage container for radioactive material, especially for spent fuel elements is described, consisting of a base body with cover, a jacket surrounding both the cover and the base body and made of a corrosion-resistant material and a carrying peg where, for saving material and space, the carrying peg is attached removably in a sleeve which is inserted in a recess of the cover. At the same time, the sleeve and jacket consist of the same material.

16 Claims, 1 Drawing Figure

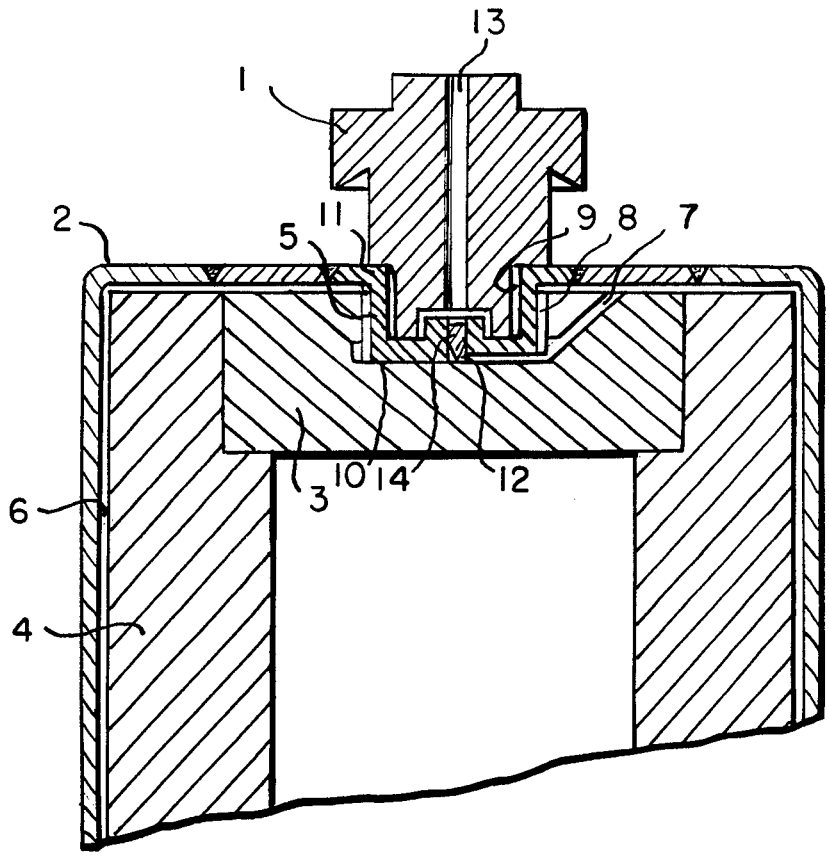
13
1
2
11
5
9
8
7
10
14
12
3
6
4

STORAGE CONTAINER AND CARRYING PEG FOR RADIOACTIVE MATERIAL

BACKGROUND OF THE INVENTION

The subject matter of the invention is a storage container for radioactive material, especially for spent fuel elements, including a base body provided with a cover, a jacket surrounding the cover and the base body on the outside and made of a corrosion-resistant material and a carrying device in the form of a lifting lug.

For the transportation and storage of heat producing radioactive substances such as, for example, spent fuel elements from nuclear power plants or waste matter from installations for the reprocessing of spent fuel elements, containers are used in which the radioactive substances are safely enclosed, from which the heat produced may be carried away safely at any time and which are critically safe.

Customarily, thick-walled containers are used which are lined on the inside with high-grade steel. Whenever the containers are to be stored underground, for example in shut down mines, then the walls of the container must be able to absorb the mechanical forces that may result from a collapse of the mine walls and must be corrosion-resistant. For reasons of economy, multilayer containers containing a base body and a jacket are used in such cases. For the base body, normally a heat-resistant, reasonably priced material is used which does not need to be corrosion resistant, since it does not come into contact with corrosive media. The container will be dimensioned in such a way, that it withstand the pressure from a mine collapse. It must be configured so that the bottom and the cover lid may be inserted or screwed in tightly.

For the jacket, corrosion-resistant materials are used. In salt mines, in which the occurrence of quinary liquors, must be taken into account, highly alloyed steels or steels on the basis of zirconium or titanium come into question.

Such containers usually contain storage cans in which the radioactive matter is placed and they are inserted on their part into shielding containers, at least during the transportation and possibly an intermediate storage. The cover of the multilayer container is provided with a fixedly mounted carrying peg by which the multilayer container is lifted and inserted into the shielding container and may possibly again be taken out of it. The minimal height of the carrying peg amounts to about 15 to 20 cm. One disadvantage of this fixedly mounted carrying peg consists in the fact that the shielding container will have to be made longer by this height. This increases the overall weight and makes the shielding container considerably more expensive. In addition, it will be necessary that the weighty carrying peg is made of the same, very expensive, corrosion-resistant material, as the corrosion-safe outside jacket in order to avoid local element formation and the like. That, too, has a disadvantageous effect as far as weight and costs are concerned. A further disadvantage is the practically point-like load on the cover below the fixedly mounted carrying peg in case of the crash of a container. The same is true naturally also for the storage cans contained in the multilayer container insofar as they are also provided with fixed carrying pegs of similar handling devices.

SUMMARY OF THE INVENTION

Therefore, the invention was based on the task of providing a storage container for radioactive material, especially for spent fuel elements from nuclear reactors including a base body provided with a cover, a jacket for the outside of the cover and the base body and made of a corrision-resistant material and a carrying device in the form of a carrying peg in which the disadvantages described above are eliminated and a utilization is ensured which saves space and material, while conserving the favorable corrosion characteristic.

The problem was solved according to the invention by making a cylindrically shaped recess in the cover, inserting a sleeve into this recess and removably attaching the carrying peg in said sleeve with the sleeve and the jacket made of the same material.

In particularly advantageous realizations/applications of the present invention, the sleeve is provided with an outside thread for the attachment in the recess and with an inside thread for the attachment of the carrying peg. Furthermore, it is advantageous to equip the sleeve with a collar and to weld the collar to the jacket.

Furthermore, it is favorable if the sleeve at least partially has a plane bottom as a sealing surface and furthermore if the sleeve and the carrier peg are equipped with a central, through-going bore for checking for leaks.

BRIEF DESCRIPTION OF THE DRAWING

The single FIGURE of the drawing is a schematic sectional view in elevation.

DETAILED DESCRIPTION

As shown in the drawing, in the cover (3) which closes the hollow base body (4) of a storage container and which is provided with a corrosion-protective jacket (2) (for example made of "Hastelloy") on all sides, there is, in recess, a sleeve (5). The sleeve (5) and the corrosion-protective jacket (2) are made of the same material. The sleeve (5) is firmly connected with the cover (3), preferably screwed into the cover (3) by means of an outside thread (8). A carrying peg (1) is connected releasably with the sleeve (5), advantageously by means of threads. Correspondingly, it is possible to equip the sleeve (5) with an inside thread (9). However, other releasable connections such as, for example, bayonet connections are possible. The sleeve (5) may be provided with a collar (11), which is welded together with the corrosion-protective jacket (2). It is advantageous, if the sleeve (5) and the carrying peg (1) are provided with a central through-going bore (12, 13) for checking the corrosion-protective jacket (2). Helium or some other suitable test gas for detecting any leakages possibly present in the welding seams may flow through the bore (12, 13) by way of a channel (7) into the gap (6) between the base body (4) or the cover (3) and the corrosion-protective jacket (2). Correspondingly, it will be particularly favorable, if the sleeve (5) has at least partially a plane bottom (10) on which, in case of need, additional sealing elements may be disposed. When leakage tests have been completed, it will be possible to close the bore (12, 13) in the sleeve (5), for example, by means of a taper pin (14) which is subsequently welded.

After handling the multilayer container, the carrying peg (1) is removed from the sleeve Thus, all the disadvantages described initially—high costs of material, waste of space and weight, as well as damage to the lid (3)—are eliminated.

It is within the scope of the invention that the solution of the task set also includes containers of smaller configuration, for example, fuel element storage cans which are placed in multilayer containers.

The entire disclosure of German priority application No. G8236359.5 is hereby incorporated by reference

What is claimed is:

1. A storage container for radioactive material, especially for spent fuel element from nuclear reactors comprising a base body provided with a cover, a jacket for the cover and the base body disposed on the outside thereof and made of a corrosion-resistant material and further including a carrying apparatus in the form in the form of a carrying peg, said peg including a body having, at one end, external threads and, adjacent the opposite end, a peripheral flange extending generally transversely of said body to facilitate grasping and holding of said peg, a cylindrically shaped recess in the cover, a sleeve inset recess and, in said sleeve said carrying peg having said threaded end threadly engaged, with the sleeve and the jacket being made of the same material.

2. A storage container according to claim 1 wherein the sleeve for attachment is provided in the recess with an outside thread for attachment and for the attachment of the carrying peg with an inside thread.

3. A storage container according to claim 2 wherein the sleeve is provided with a shoulder and the latter is welded together with the jacket.

4. A storage container according to claim 1 wherein the sleeve is provided with a shoulder and the latter is welded together with the jacket.

5. A storage container according to claim 4 wherein the sleeve has at least partially a plane bottom as a sealing surface.

6. A storage container according to claim 3 wherein the sleeve has at least partially a plane bottom as a sealing surface.

7. A storage container according to claim 2 wherein the sleeve has at least partially a plane bottom as a sealing surface.

8. A storage container according to claim 1 wherein the sleeve has at least partially a plane bottom as a sealing surface.

9. A storage container according to claim 8 wherein the sleeve and carrying peg are provided with a central bore, one bore fitting on top of the other for checking leakages.

10. A storage container according to claim 7 wherein the sleeve and carrying peg are provided with a central bore, one bore fitting on top of the other for checking leakages.

11. A storage container according to claim 6 wherein the sleeve and carrying peg are provided with a central bore, one bore fitting on top of the other for checking leakages.

12. A storage container acording to claim 5 wherein the sleeve and carrying peg are provided with a central bore, one bore fitting on top of the other for checking leakages.

13. A storage container according to claim 4 wherein the sleeve and carrying peg are provided with a central bore, one bore fitting on top of the other for checking leakages.

14. A storage container according to claim 3 wherein the sleeve and carrying peg are provided with a central bore, one bore fitting on top of the other for checking leakages.

15. A storage container according to claim 2 wherein the sleeve and carrying peg are provided with a central bore, one bore fitting on top of the other for checking leakages.

16. A storage container according to claim 1 wherein the sleeve and carrying peg are provided with a central bore, one bore fitting on top of the other for checking leakages.

* * * * *